US007934568B2

(12) United States Patent
Myrick

(10) Patent No.: US 7,934,568 B2
(45) Date of Patent: May 3, 2011

(54) ROCK CORE REMOVAL METHOD AND APPARATUS

(76) Inventor: Thomas M. Myrick, Maidens, VA (US)

( * ) Notice: Subject to any disclaimer, the term of this patent is extended or adjusted under 35 U.S.C. 154(b) by 382 days.

(21) Appl. No.: 12/143,986

(22) Filed: Jun. 23, 2008

(65) Prior Publication Data

US 2009/0000822 A1 Jan. 1, 2009

Related U.S. Application Data

(60) Provisional application No. 60/937,142, filed on Jun. 27, 2007.

(51) Int. Cl.
*E21B 49/02* (2006.01)

(52) U.S. Cl. ..... 175/58; 175/20; 175/244; 175/249; 175/251

(58) Field of Classification Search ..... 175/20, 175/58, 244, 245, 246, 249, 251, 252, 253, 175/403
See application file for complete search history.

(56) References Cited

U.S. PATENT DOCUMENTS 2,537,605 A 1/1951 Sewell
3,086,602 A 4/1963 Henderson
4,566,545 A * 1/1986 Story et al. ..... 175/226
4,694,916 A 9/1987 Ford
5,211,249 A 5/1993 Richter
6,550,549 B2 4/2003 Myrick
6,719,070 B1 * 4/2004 Puymbroeck et al. ..... 175/59

* cited by examiner

*Primary Examiner* — Kenneth Thompson
*Assistant Examiner* — Sean Andrish
(74) *Attorney, Agent, or Firm* — Goodman, Allen & Filetti, PLLC

(57) ABSTRACT

A rock core removal method and apparatus allows efficient, safe, and reliable removal of a rock core sample. An inner collet tube and an outer ground tube, within a drill tube, protect the core sample during drilling. At depth, the collet tube is raised with respect to the ground tube so that the conical wall of the ground tube pushes constricting fingers on the collet tube inward, gripping the core sample within. The collet tube and ground tube are then raised, rotated, or raised and rotated, applying the necessary force to break the core sample off of the substrate. After retracting the tubes, the collet tube is lowered with respect to the ground tube to release the core sample. An ejection rod then pushes the core sample out of the collet tube. The ground tube may also act as the actuating means for a quick-change drill-bit release feature.

13 Claims, 11 Drawing Sheets

ROCK CORE REMOVAL METHOD AND APPARATUS

This U.S. patent application claims the priority from U.S. Provisional Application No. 60/937,142 on Jun. 27, 2007 by the same inventor having the title "Collet Core Removal."

BACKGROUND ART

This invention generally relates to a method and apparatus for taking a rock core drilling sample. In particular, the invention is directed to an improved method of taking core samples from base rock at any depth using simple elements in a controlled and reliable fashion. Some preferred embodiments of this invention are particularly useful for removing rock core samples in extraterrestrial environments.

Some current core sample removal techniques consist of drilling completely through the base rock in order to obtain a core sample. It is often impractical to drill completely through the rock to be sampled. The depth of the base rock may not be known, or if it is known, may be far deeper than the desired sampling depth.

Some current core sample removal techniques consist of drilling to a desired depth and rocking the drill shaft back and forth until the core sample cracks away from the base rock. When obtaining a core sample by drilling to the desired depth and rocking the drill shaft back and forth, several problems arise. The cutting annulus must be great enough to provide sufficient movement of the drill shaft as it is rocked back and forth. As the cutting annulus size increases, the drill tends to operate slower, work less efficiently, and generate more dust. If the drill depth is several times greater than the drill diameter, the cutting annulus must be further increased so as to provide the same rocking angle. Soon it becomes impractical to use this method of core sample removal at any depth greater than several drill diameters. Drill shaft flexing will also detract from the available rocking angle.

Some current core sample removal techniques apply relatively large external loads to the drill shaft which must react to ground. Some current core sampling techniques can therefore become difficult in sandy or soft surroundings. Additionally, in extraterrestrial environments, many of the weight, power, and cost restraints make undesirable a drilling apparatus requiring such external loads reacting to ground.

Some current core sample removal techniques subject the core sample to strong, rotational friction forces while drilling, which can result in inadvertent, premature core breakage. These premature breakages can cause the core sample to become jammed within the collection device. Additionally, the rotational friction forces against the core sample may cause particles to break off of the core sample and accumulate as dust. This dust may clog different parts of the drilling and core removal apparatus rendering either certain parts inoperable or possibly rendering the entire drilling and core removal apparatus inoperable.

Some current core sample removal techniques do not provide for a drill bit quick-change mechanism. In order to change the drill bit, often the entire drilling and core removal apparatus must be removed from the hole and changed using extra equipment. Some current core sample removal techniques run the risk of having the drill tube or possibly the entire drilling mechanism rendered inoperable and immobile if the drill bit gets clogged, broken, or otherwise stuck while still in the hole. Additionally, in extraterrestrial environments, the drilling and core removal apparatus is often attached to an autonomous research platform with other pieces of scientific equipment. If the drill bit were to become stuck in the hole it was drilling and no drill bit quick-change mechanism were available to release the drill bit while it remained within the hole, then the entire research platform may be rendered immovable and many of the pieces of scientific equipment may be rendered immobile and thus inoperable.

Some current core sample removal techniques provide a quick-change means for the drill bit, but are unable to obtain the core sample if the drill bit must be released during a drilling operation.

Some current core sample removal techniques do not provide for a stable bushing support to the drill bit during the drilling process.

Some current core sample removal techniques are not reliable enough to be run autonomously. Reliable and autonomous core sample removal techniques are particularly necessary in extraterrestrial environments.

Some current core sample removal techniques also require a large number of moving parts in order to achieve the drilling, core removal, core ejection, and drill bit changing actions. The large number of moving parts can increase the cost of the mechanisms, impart a loss of drilling efficiency, increase the cost of necessary repairs, and increase the downtime required for repairs. Additionally, in extraterrestrial environments, such a large number of moving parts may be unable to comply with weight, power, and cost restrictions.

SUMMARY OF THE INVENTION

Generally, a preferred embodiment of this invention comprises a coaxial arrangement of a cylindrical collet tube located within a cylindrical ground tube which is located within a cylindrical drill tube with a drill bit affixed to one end. In a preferred embodiment, the drill bit is connected to the drill tube through a quick-change mechanism. The collet tube has constricting fingers near its collecting end which are able to flex inward towards the center axis in order to decrease the diameter of the collet tube's collecting end. In a preferred embodiment, features in the collet tube, ground tube, or both tubes cause the collet tube's constricting fingers to flex towards the center axis when the collet tube is moved upwards a small distance with respect to the ground tube, thus allowing the collet tube to grip a core sample that has been drilled.

In multiple preferred embodiments, the collet tube can be raised with respect to the ground tube to grab the core sample, and then, with respect to the drill tube and drill bit, both the collet tube and ground tube can be (1) raised to break off the core sample solely through tension, (2) rotated until the core sample is broken off solely through torsion, or (3) raised and rotated to break off the core sample through a combination of tension and torsion. A preferred embodiment may allow for the user to adjust the desired proportion of tension to torsion used to break the core sample. An alternate preferred embodiment would allow this apparatus to be manufactured with a specific ratio of tension to torsion. In a preferred embodiment, the same movement actuator that causes the collet tube to grip the core also acts to rotate and raise the collet tube and ground tube in the core sample break-off process.

In a preferred embodiment, an ejection rod is used to push the core sample out of the collet tube after the collet tube is lowered with respect to the ground tube in order to release its grip on the core sample. The ejection rod also serves to change operating modes of the movement actuator that first causes the collet tube to grip the core sample and later rotates and raises the collet tube and ground tube combination. This embodiment would eliminate the need for additional actuators and simplify the design.

During the drilling process, the collet tube and ground tube are rotationally secured so as not to rotate with the drill tube and drill bit. The collet tube and ground tube thus act as non-rotating "sleeves" which protect the core sample from inadvertent breakage while drilling. The protection of the core sample during drilling as well as the unique break-off method allows for the retrieval of much longer core samples than permitted by prior art methods and devices. Additionally, the non-rotating "sleeves" also protect the entire drilling and core removal apparatus from the danger of dust buildup. At the same time, the ground tube also acts as a stable bushing support for the drill bit.

In a further preferred embodiment, a drill bit quick-change mechanism is employed to allow for rapid changing of stuck, broken, worn, or different drill bits in a reliable autonomous fashion without the need for additional actuators. In multiple embodiments, the extra range of movement of the ground tube that is not employed in the core break-off process may be used to actuate the quick-change mechanism. In a preferred embodiment, the attachment end of the drill tube has small tabbed features capable of moving outward so as to engage a groove in the inner diameter of the drill bit. In this preferred embodiment, the ground tube generally forces the drill tube's tabbed features outwards into the grooved recesses of the drill bit. In this preferred embodiment, the ground tube is shaped so that when it is moved through its extra range of motion, it allows the drill tube's tabbed features to move inward and release the drill bit. Preferred embodiments may use drill bit quick-change mechanisms that secure the drill bit both vertically and rotationally or only vertically. If the drill bit quick-change mechanism only secures the drill bit vertically, an alternate method, such as keyed features, must be used to rotationally couple the drill bit and drill tube. Such preferred embodiments would allow the drill tube, collet tube, ground tube, core sample, and other parts to be saved and retrieved even if the drill bit becomes stuck in the hole it is drilling.

A preferred embodiment of this invention allows the core removal apparatus to be powered by only four motors: one to rotate the collet nut, one to move the ejection rod lead screw, one to operate the drill tube, and one to move the entire assembly in and out of the ground. While the motors are not shown or described in this invention, it is readily apparent to one skilled in the art how such motors would be attached when this core removal apparatus is to be used.

Further areas of applicability will become apparent from the description provided herein. It should be understood that the description and specific examples are intended for purposes of illustration only and are not intended to limit the scope of the present disclosure.

DESCRIPTION OF THE DRAWINGS

The drawings described herein are for illustration purposes only and are not intended to limit the scope of the present disclosure in any way. The hatch patterns used in the following drawings are not intended to show specific or different material types.

DETAILED DESCRIPTION

Figure 1:
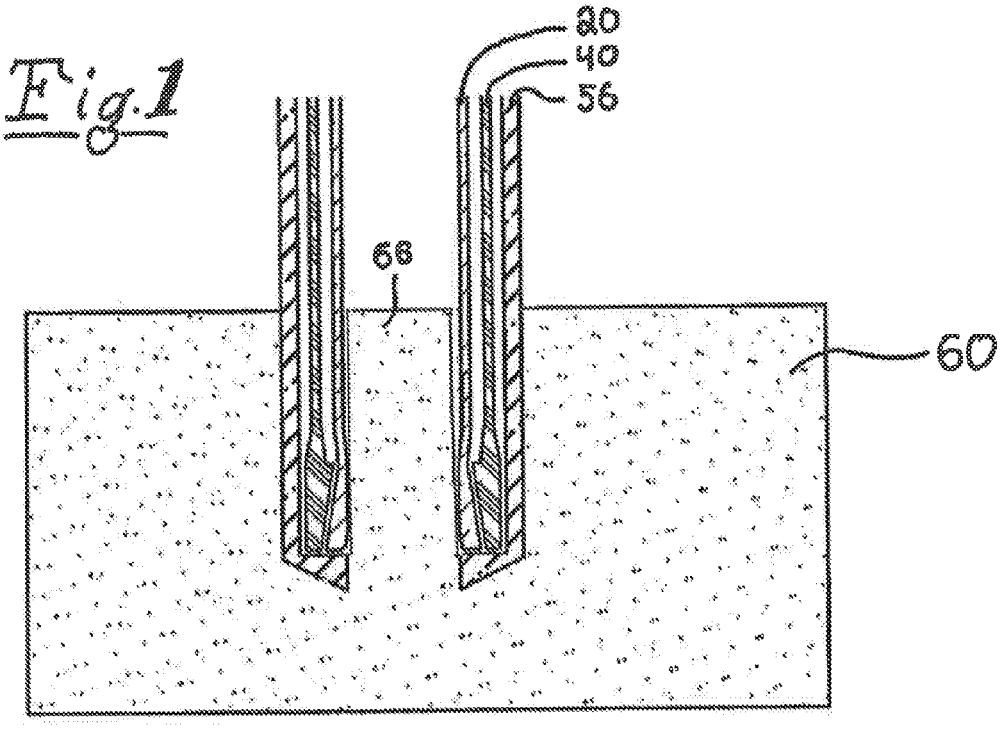
FIG. 1 is a sectional view showing a preferred embodiment of the invention drilled into a material and depicting the collet tube, ground tube, and drill bit during the drilling process.

The following description is merely exemplary in nature and is not intended to limit the present disclosure, application, or uses. It should be understood that throughout the drawings, corresponding reference numerals indicate like or corresponding parts and features.

Figure 3:
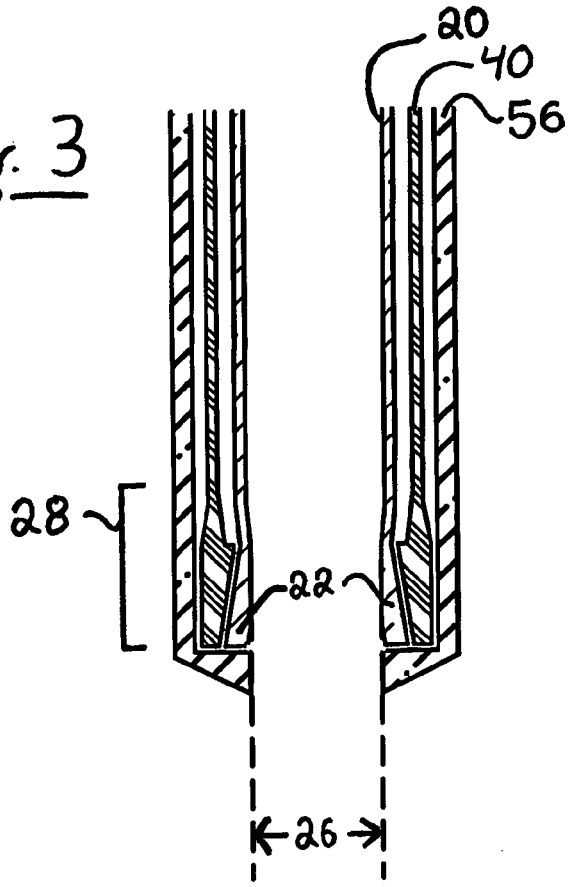
FIG. 3 is a sectional view showing a preferred embodiment of the collecting ends of the collet tube and ground tube in drilling alignment showing the collet free diameter as a dashed line.
Figure 11:
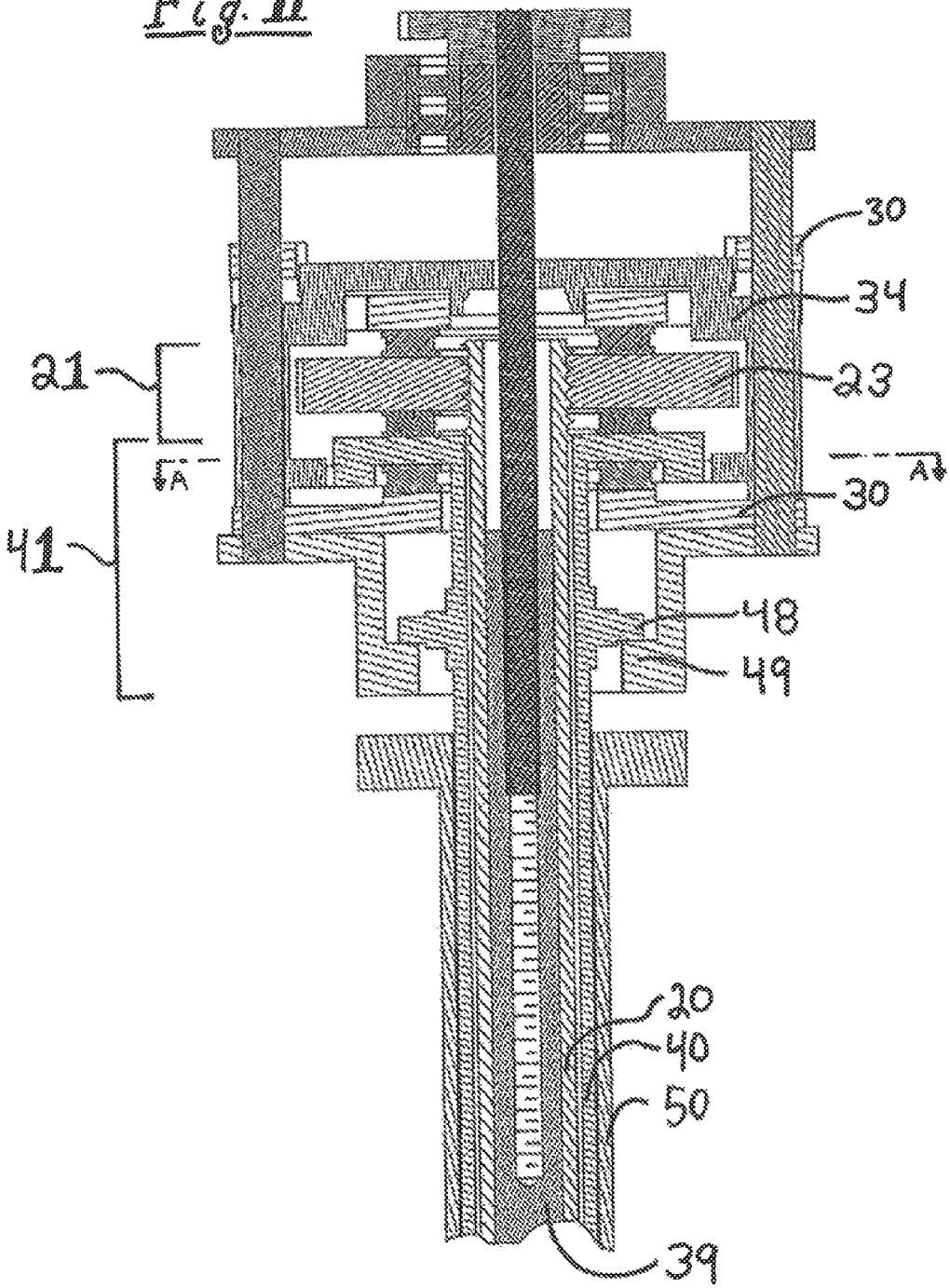
FIG. 11 is a sectional view showing a preferred embodiment of the driving system of the invention showing the collet tube, ground tube, and ejection rod in drilling alignment.

Referring to FIG. 3, the collecting end of the collet core removal apparatus is shown, made up of a collet tube 20 located within a ground tube 40 which is further located within a drill tube 50. Referring to FIG. 11, the collet tube 20 has a collet tube driving end 21. The ground tube 40 also has a ground tube driving end 41.

Figure 4:
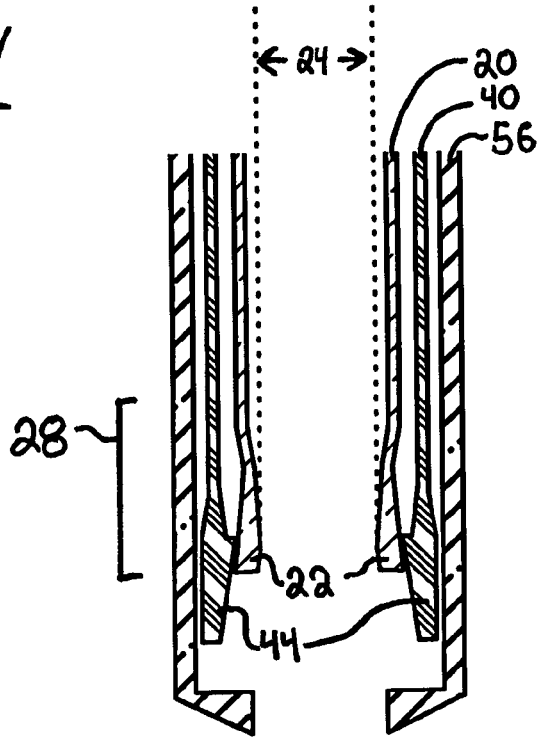
FIG. 4 is a sectional view showing a preferred embodiment of the collecting ends of the collet tube and ground tube in gripping alignment showing the constriction diameter as a dotted line.
Figure 7:
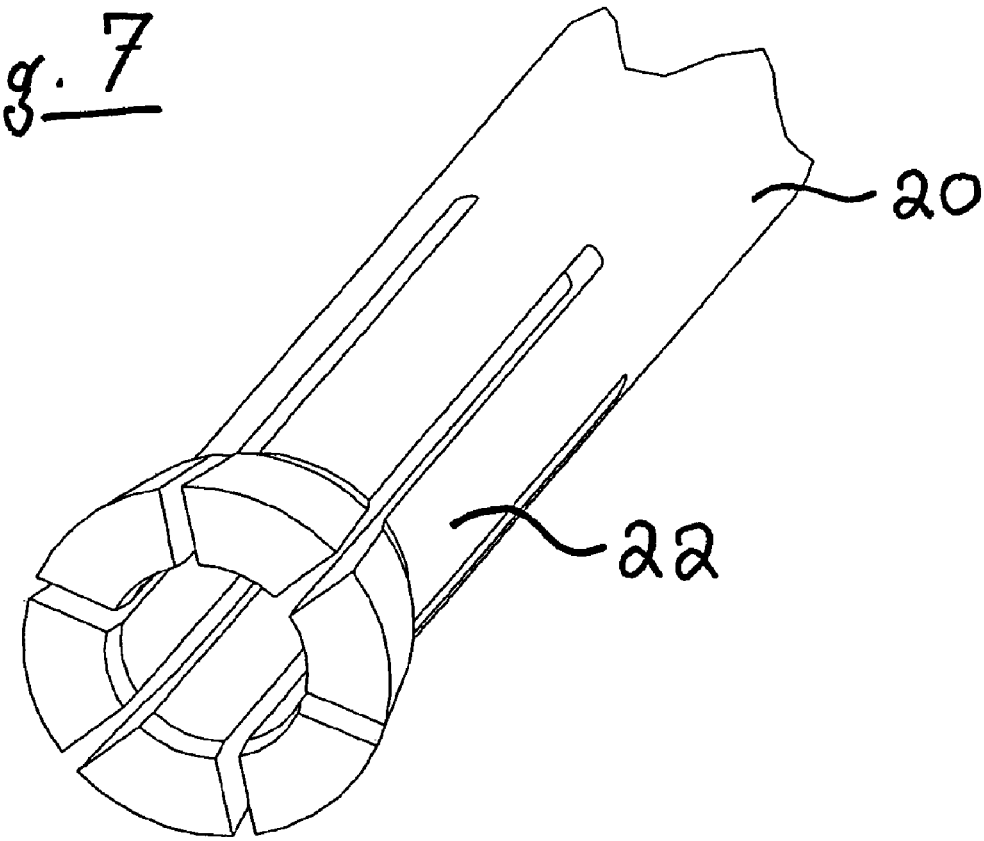
FIG. 7 is an isometric view of a preferred embodiment of the collecting end of the collet tube.

Referring back to FIG. 3, the collet tube collecting end 28 has constricting fingers 22 that are capable of flexing inwards radially. Referring to FIG. 7, the constricting fingers 22 of the collet tube 20 can vary in design, material, and number. One preferred embodiment which is depicted in FIG. 7 shows the constricting fingers 22 formed by slats of collet tube material. It is readily apparent to one skilled in the art that alternative attachment or flexing methods may be used to provide constricting fingers 22 capable of flexing inwards. Referring to FIGS. 3-4, it is readily apparent to one skilled in the art that alternative constricting fingers 22 may be used as long as they are capable of creating a constriction diameter 24 at the collet tube collecting end 28 which is smaller than the collet free diameter 26 when a force is applied by the conical features 44 of the ground tube 40. Referring to FIG. 1, in use, the drill bit 56 drills into a substrate 60 to a desired depth. During the drilling process, the collet tube 20 and ground tube 40 are held rotationally fixed with respect to the substrate 60 so as to provide a non-rotating protective sleeve around the core sample 66. The non-rotating nature of the collet tube 20 and ground tube 40 is important in protecting the core sample 66 from inadvertent breakage and damage which can cause the core sample 66 to become stuck within the drilling and core removal apparatus.

Figure 10:
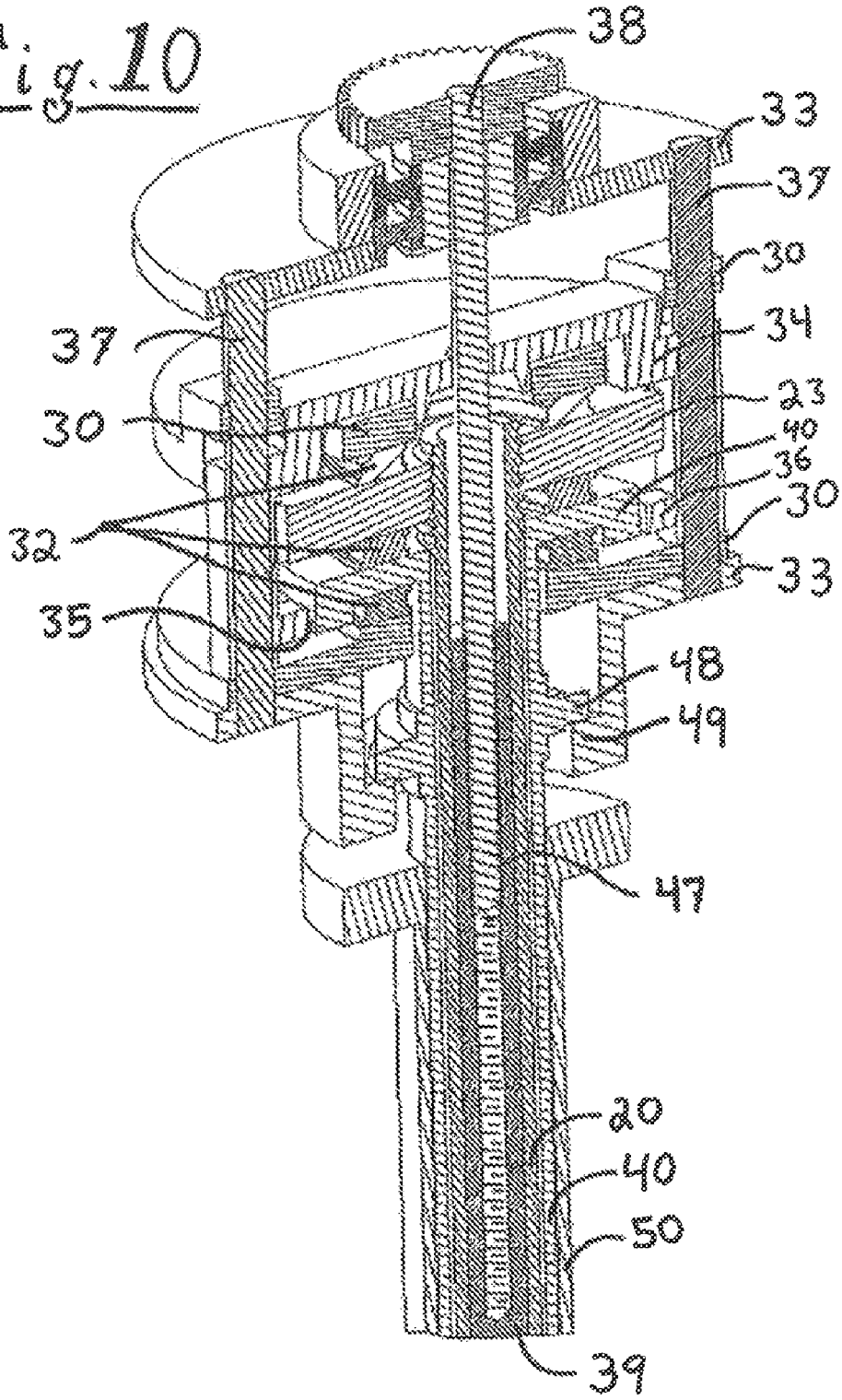
FIG. 10 is an isometric cross section view showing a preferred embodiment of the driving system of the invention in drilling alignment.

Referring to FIG. 10, located within the collet tube 20 is an ejection rod 39. The ejection rod 39 moves linearly and serves to positively eject a core sample 66 from the collet tube 20. During drilling, the bottom of the ejection rod 39 is raised to allow for the length of the core sample 66 within the collet tube 20. In a preferred embodiment, the range of motion of the ejection rod 39 is greater than the maximum desired core sample 66 length. This additional range of motion may be used for other purposes. In a preferred embodiment, these other purposes would be to rotationally lock or unlock the ground tube 40 and to serve as an actuator for the drill bit quick-change mechanism.

Figure 2:
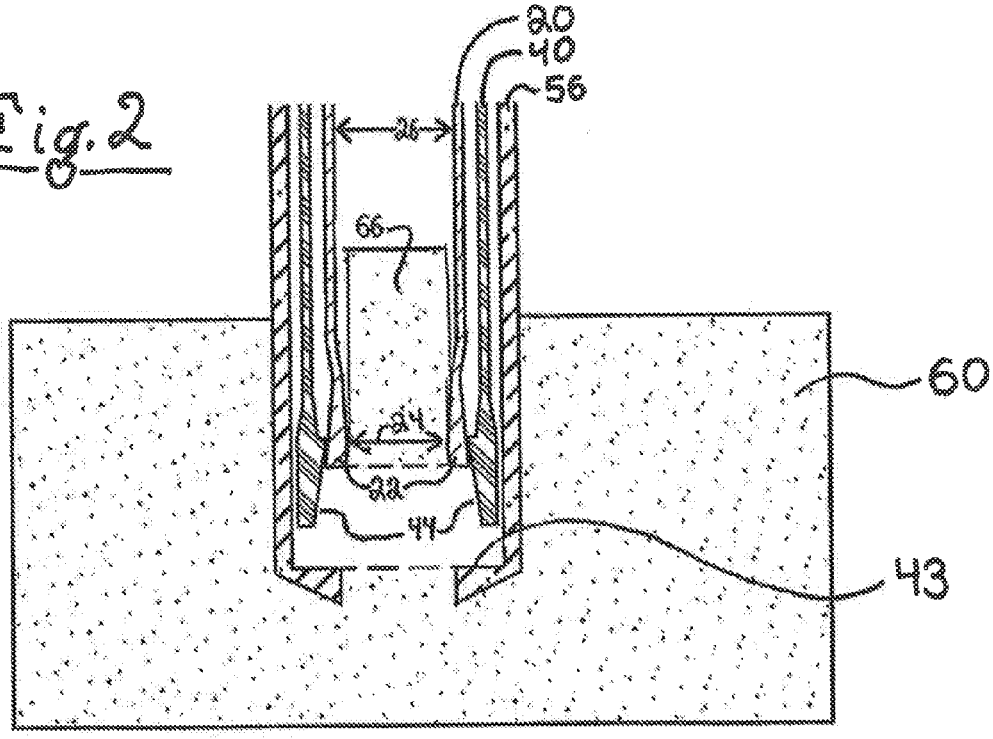
FIG. 2 is a sectional view showing a preferred embodiment of the invention drilled into a material and depicting the collet tube, ground tube, and drill bit during the core sample breaking off process.

Referring to FIG. 2, at the desired depth, the collet tube 20 is then moved axially with respect to the ground tube 40 so that the constricting fingers 22 of the collet tube 20 are pushed radially inwards by the conical features 44 of the ground tube 40.

The embodiment shown in FIG. 2 depicts the constricting fingers 22 being physically pushed inwards by conical features 44 taking the form of inclined planes. This inward pushing occurs when the collet tube 20 is raised with respect to the ground tube 40. It is readily apparent to one skilled in the art that the required deflection of the constricting fingers 22 by the conical features 44 may be accomplished through the use of other constricting finger shapes and materials, other conical feature shapes and materials, and other axial movements of the collet tube 20 with respect to the ground tube 40. The terms "constricting fingers" and "conical features" are exemplary of certain preferred embodiments, but may take on different shapes and designs not finger-like in nature and not conical in nature respectively.

Because of the relationship between the constricting fingers 22 of the collet tube 20 and the conical features 44 of the ground tube 40, the collet tube 20 will grip the core sample 66 when raised with respect to the ground tube 40. After the collet tube 20 grips the core sample 66, the collet tube 20 and ground tube 40 are together raised, rotated, or raised and rotated so as to break the core sample 66 from the substrate 60 through either tension, torsion, or a combination of tension and torsion.

Referring to FIG. 11, a preferred embodiment of the driving end of the core removal apparatus is shown in the drilling position. This position is used during the initial drilling phase of rock core removal. Not shown in any views are features of the collet tube 20 and ground tube 40 which lock the two tubes together rotationally. It is readily apparent to one skilled in the art that a variety of features may be used to rotationally couple these two coaxial cylinders. Shown in the figure is a rotational lock 34 that is engaged with the driving end of the ground tube 41 so that the ground tube 40 is fixed from rotating with respect to the axial framework 30. Not shown in any of the views, but present in a preferred embodiment of the invention, are springs that apply a downward biasing force to both the rotational lock 34 and the axial framework 30. The collet nut 23 is a gear with threads cut at the center that match threads on the outer diameter of the driving end of the collet tube 20. The collet nut 23 is capable of being driven by a low speed, high torque reversible motor (not shown). In the drilling position, the collet nut 23 has been rotated in a reverse direction, thus lowering the collet tube 20 to a point where the collet fingers 22 are relaxed and at the collet free diameter 26 during the drilling process.

Figure 12:
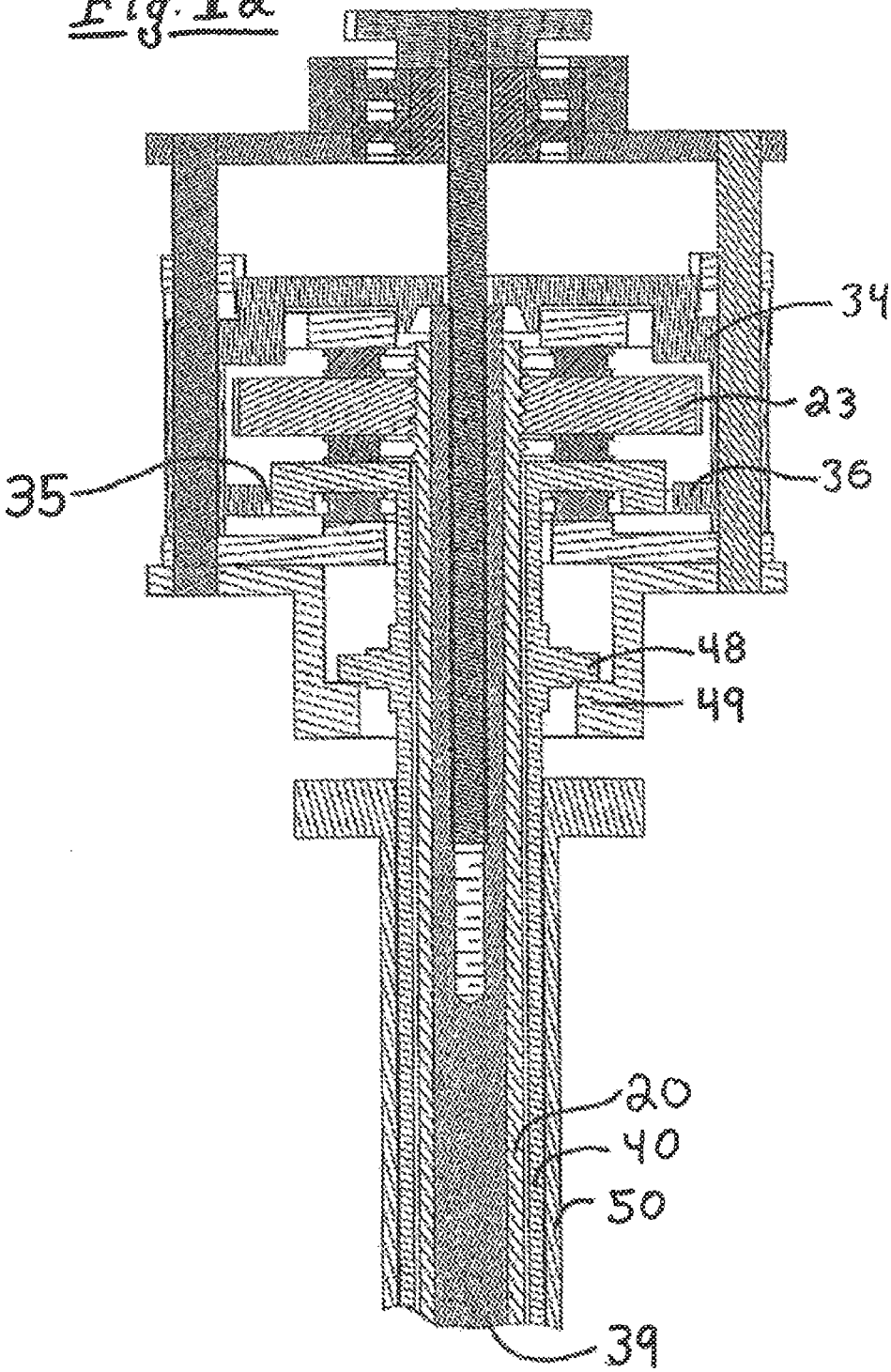
FIG. 12 is a sectional view showing a preferred embodiment of the driving system of the invention showing the collet tube, ground tube, and ejection rod in core sample gripping alignment.

Referring to FIG. 12, a preferred embodiment of the driving end of the core removal apparatus is shown in the gripping position. This position is used after the drilling phase and before the breaking phase. In the gripping position, the collet tube 20 has been raised axially with respect to the ground tube 40 by rotating the collet nut 23. This raising action constricts the collet fingers 22 and causes the collet tube 20 to grip the rock core 66. The ground tube 40 is prevented from rotating with the collet nut 23 because the locking tabs 36 of the rotational lock 34 are engaged with notches 35 cut into the ground tube driving end 41. Because of this rotational lock 34 and the rotational coupling of the ground tube 40 with the collet tube 20, the collet tube 20 is thus held rotationally fixed ensuring that the torque applied to the collet nut 23 forces the collet tube 20 to be raised axially, gripping the core sample 66.

Figure 13:
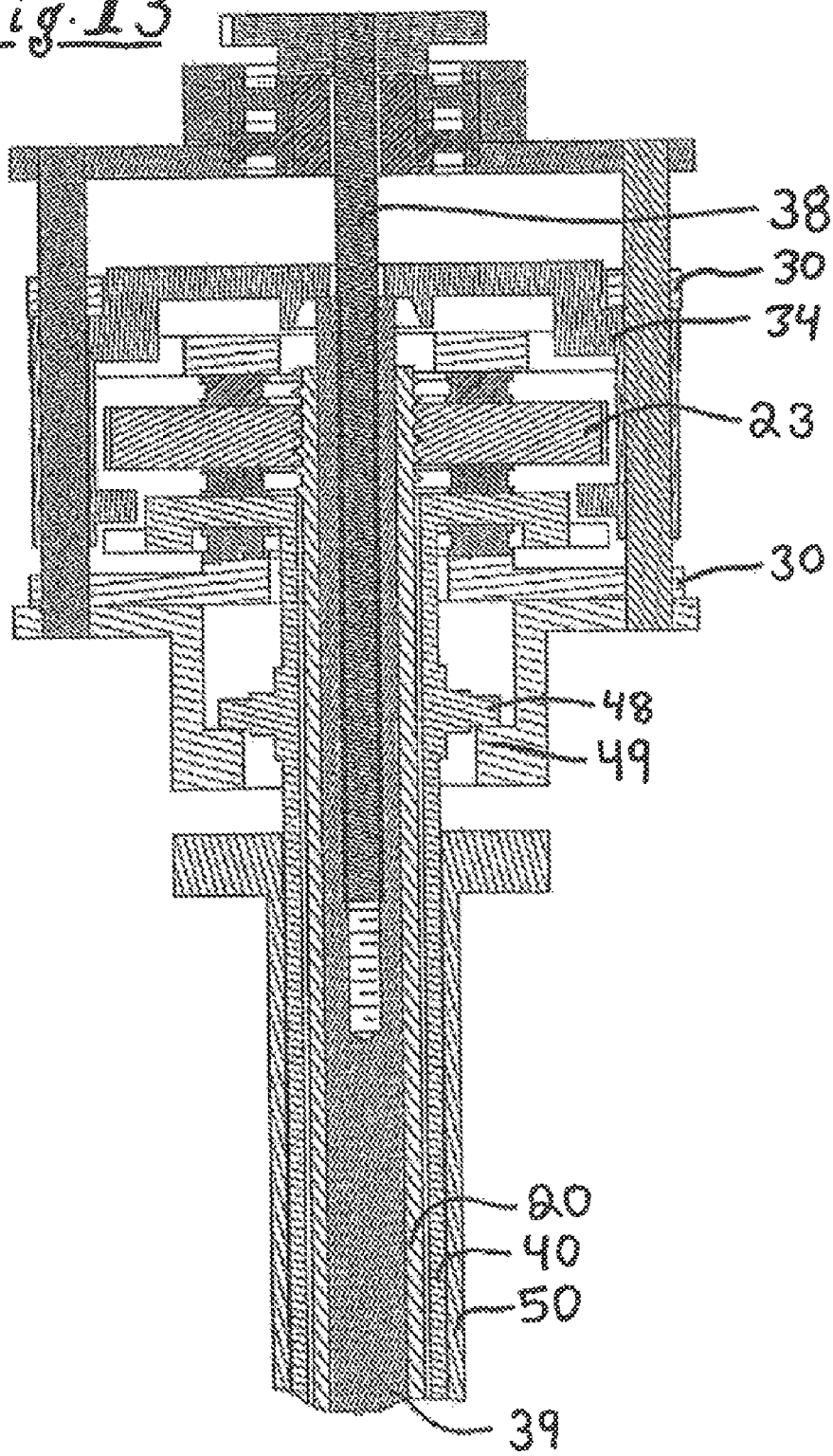
FIG. 13 is a sectional view showing a preferred embodiment of the driving system of the invention showing the collet tube, ground tube, and ejection rod in core sample break-off alignment.

Referring to FIG. 13, a preferred embodiment of the driving end of the core removal apparatus is shown in the breaking position. This position is used to break the core sample apart from the substrate. In the breaking position, the ejection rod 39 has been raised, using the ejection rod lead screw 38, to a point where it lifts the rotational lock 34, and the locking tabs 36 against downward biasing springs (not shown) a small distance, thus releasing the rotational lock 34 and its locking tabs 36 from the ground tube 40. This action frees the ground tube 40 from being rotationally fixed with respect to the axial framework 30. At this point, the collet nut 23 is again rotated in the same direction as used when gripping the core. As the core sample 66 is already gripped with significant force, the additional movement of the collet nut 23 causes both the collet tube 20 and the ground tube 40 to rotate together. This action will torsionally break the core sample 66 from the substrate 60.

It is possible that the gripping force applied to the collet fingers 22 onto the core sample 66 via the tightening collet nut 23 is not sufficient to prevent rotational or axial slipping of the collet fingers 22 as the ground tube 40 and collet tube 20 are actuated to rotate and break the core sample 66. If this occurs, the collet nut 23 can be actuated to "reset" the grip of the collet fingers 22 onto the core sample 66 with an increased force and execute the break-off sequence again.

An alternate embodiment involves designing the pitch of the threads on the collet nut 23 and collet tube 20 as well as the slope of the constricting fingers 22 and the conical features 44 such that the gripping force applied to the collet fingers 22 through torque applied to the collet tube 20 will continue to increase until the magnitude of torque equals that needed to break the core sample 66 from the substrate 60. In other words, as long as there is a sufficient "biting" grip or sufficient preload on the core sample 66, when the rotational lock 34 is raised to free the ground tube 40 and collet tube 20 to rotate, the collet nut 23 will continue to tighten the grip onto the core sample 66 without slipping until the torsional breaking force needed to separate the core sample 66 from the substrate 60 is equal to the ever increasing torque that is applied to the collet tube 20. In this way, it is not necessary to know, in advance, the gripping force needed to insure the collet fingers 22 do not slip on the core sample 66 when the core sample 66 is to be broken off. The mechanism will continue to tighten its grip on the core sample 66 until the core sample 66 breaks from the substrate 60.

Referring to FIGS. 10-14, a core tensioning cam 49 is shown. The core tensioning cam is used with the core removal apparatus when tension is to be applied to the core sample 66 during the breaking process. As the ground tube 40 rotates to torsionally break the rock, the addition of the core tensioning cam 49 will raise the ground tube 40 and collet tube 20 as the ground tube cam followers 48 ride up the slope of the cam profile of the core tensioning cam 49. This action will impart a tensile and torsional breaking force onto the core sample 66. It is readily apparent to one skilled in the art that other methods of driving the collet tube 20 and ground tube 40 are available and may be used as long as they are capable of providing either or both, torsion and tension to the rock core.

Referring to FIG. 11, after the core sample 66 has been broken free from the substrate 60, the collet tube 20 and ground tube 40 can be removed from the substrate 60 either with or without the drill bit 56. Once removed from the substrate 60, the collet tube 20 can be moved axially with respect to the ground tube 40 so that the constricting fingers 22 no longer grip the core sample 66. Then, the core sample 66 can either be left to fall out of the collet tube 20 or, preferably, be forced out through the means of an ejection rod 39.

Figure 6:
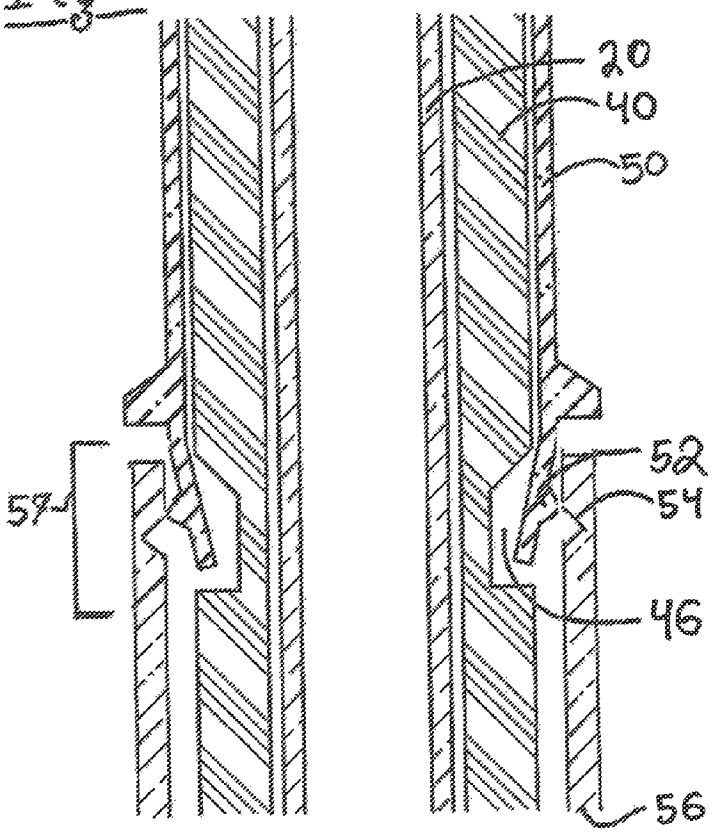
FIG. 6 is a sectional view showing a preferred embodiment of the attachment end of the drill tube, the ground tube, and the collet tube in the quick-change alignment showing the ground tube's outer wall allowing the drill tube's tabbed features to disengage the drill bit's grooved recesses.
Figure 5:
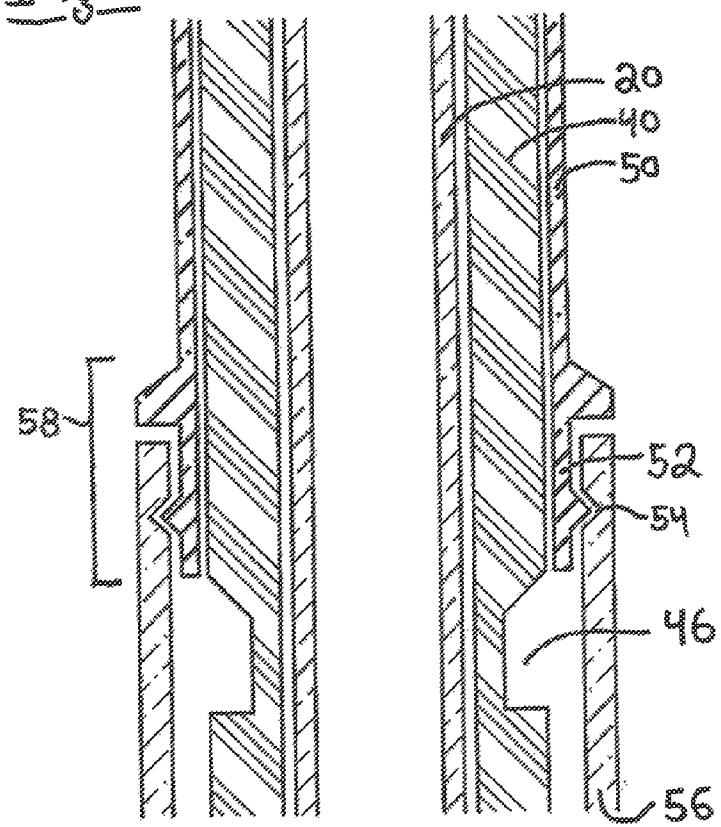
FIG. 5 is a sectional view showing a preferred embodiment of the attachment end of the drill tube, the ground tube, and the collet tube in the drilling alignment showing the ground tube's outer wall keeping the drill tube's tabbed features within the drill bit's grooved recesses.
Figure 14:
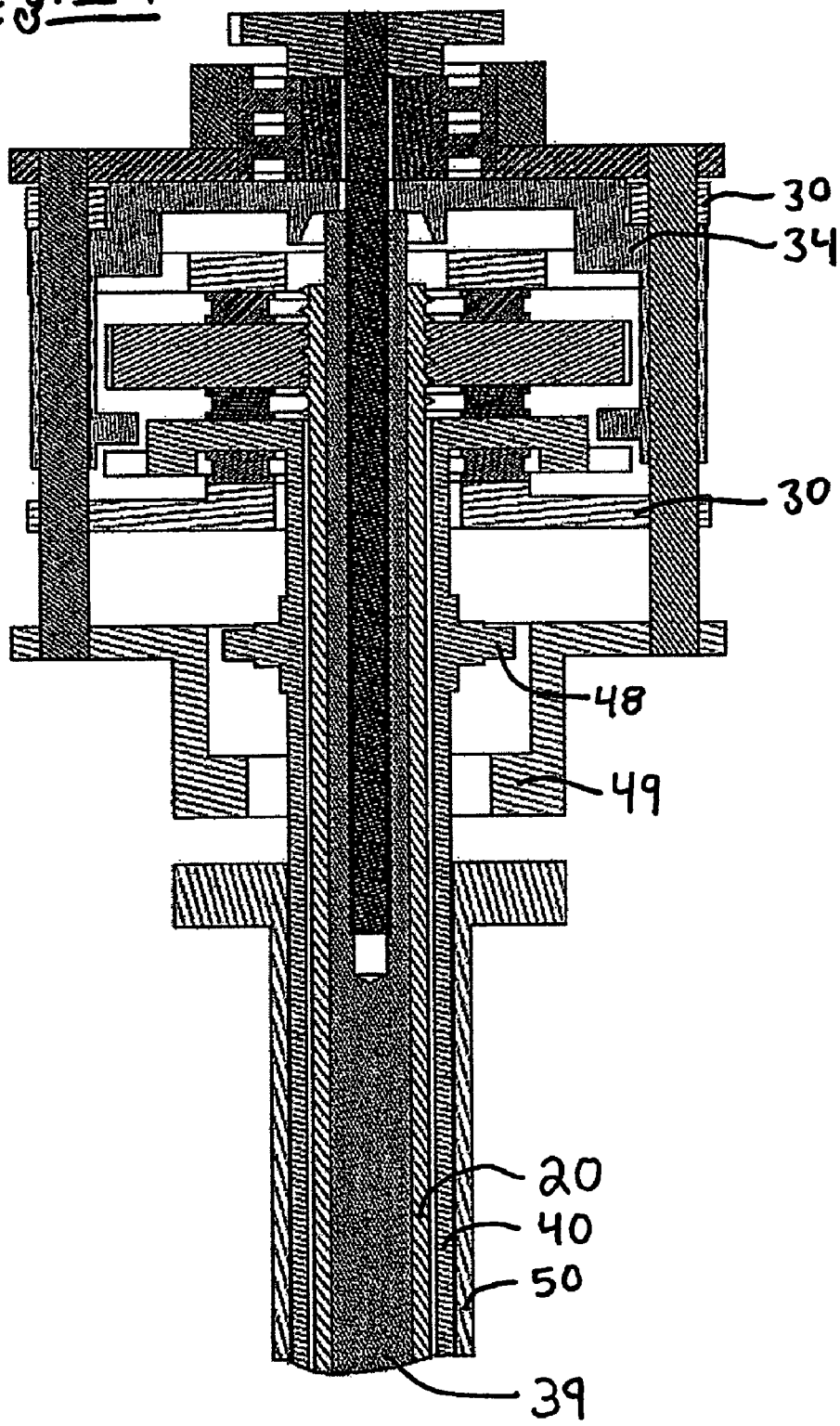
FIG. 14 is a sectional view showing a preferred embodiment of the driving system of the invention showing the collet tube, ground tube and ejection rod in drill bit quick-release alignment.

Referring to FIG. 14, a preferred embodiment of the driving end of the core removal apparatus is shown in the drill bit quick-change position. This position is used to remove the drill bit 56 from the drill tube 50. In addition to supporting the drill tube 50 and drill bit 56 and providing the actuating means for flexing the constricting fingers 22 of the collet tube 20, the ground tube 40 also acts as the actuating means for the drill bit quick-change mechanism. Referring to FIGS. 5-6, a preferred embodiment of the invention shows, at the drill tube attachment end 58, the drill tube 50 having flexing tabbed features 52 located on its outer surface. At the drill bit attachment end 57, the drill bit 56 has a grooved recess 54 that is matched in shape so as to physically engage with the tabbed features 52 of the drill tube 50. It is apparent to one skilled in the art that the tabbed features 52 and grooved recess 54 may have different designs and shapes and may come in different numbers. Additionally, it is apparent to one skilled in the art that the tabbed features 52 and grooved recess 54 may either couple the drill tube 50 to the drill bit 56 axially or axially and rotationally. If the tabbed features 52 and grooved recess 54 couple the drill tube 50 to the drill bit 56 only axially, then another means must be used to couple the drill tube 50 to the drill bit 56 rotationally.

FIG. 5 shows the ground tube 40 in normal drilling position where its outer wall remains in close contact with the tabbed features 52 of the drill tube 50. FIG. 6 shows the ground tube 40 raised axially to the drill bit quick-change position, located past the ground tube's 40 normal range of axial movement necessary to break the core sample 66 from the substrate 60. In this drill bit quick-change position, the tabbed features 52 of the drill tube 50 are capable of flexing inwards because the ground tube 40 is no longer in close contact with the tabbed features 52 due to a shaped recess 46 in the outer wall of the ground tube 40. In this alignment, the tabbed features 52 may now flex inwards and away from the grooved recess 54, thus allowing the drill bit 56 to be removed from the drill tube 50 with ease.

FIG. 14 shows the driving mechanism in the drill bit quick-change position. The ejection rod 39 has raised the rotational lock 34 and axial framework 30 to their uppermost position. Referring back to FIG. 5, this raising action moves the ground tube 40 and collet tube 20 to a point where the ground tube recess 46 is in line with the tabbed features 52 of the drill tube 50 so that the drill bit 56 can be released. It is apparent to one skilled in the art that different shapes and designs of the shaped recess 46 in the outer wall of the ground tube 40 may be used to allow the tabbed features 52 to deflect inwards and away from the grooved recess 54. It is also apparent to one skilled in the art that many different shapes and designs of tabbed features 52 may be used to engage many different shapes and designs of one or more grooved recesses 54 of the drill bit 56 as long as the tabbed features 52 are capable of deflecting inwards when not supported and capable of effectively coupling the drill bit 56 and drill tube 50 axially or axially and rotationally when supported by the ground tube 40.

In a preferred embodiment of the invention, the drill bit quick-change mechanism allows for the drill bit 56 to be detached and remain within the substrate 60 while allowing the core sample 66 to be retained and removed by the removing the ground tube 40 and collet tube 20 from the substrate 60.

Referring to FIG. 10, a cross section isometric view of a preferred embodiment of the driving mechanism is shown. Relative ground elements 33 are connected through axial guide rods 37. The ejection rod 39 is moved axially through the use of an ejection rod lead screw 38 via cooperating threads 47. The ejection lead screw 38 is capable of being turned by an external motor (not shown). The core tensioning cam 49 is shown as part of the relative ground elements 33. In an embodiment not depicted in any of the views, when the ground tube 40 is not equipped with ground tube cam followers 48 and the device is manufactured to break the core sample 66 using only torsional force, the bottom piece of the relative ground elements 33 may be manufactured without the core tensioning cam 49 or the space available for movement of the ground tube cam followers 48. The axial framework 30 is shown as two shaped plates connected together by axial connection elements 31 and capable of moving axially along the axial guide rods 37. The rotational lock 34 is shown with its locking tabs 36 presently engaging notches 35 in the ground tube 40. The collet nut 23 and the ground tube 40 are both resting between thrust bearings 32 so that they are capable of moving rotationally while remaining axially connected to the axial framework 30.

Figure 9:
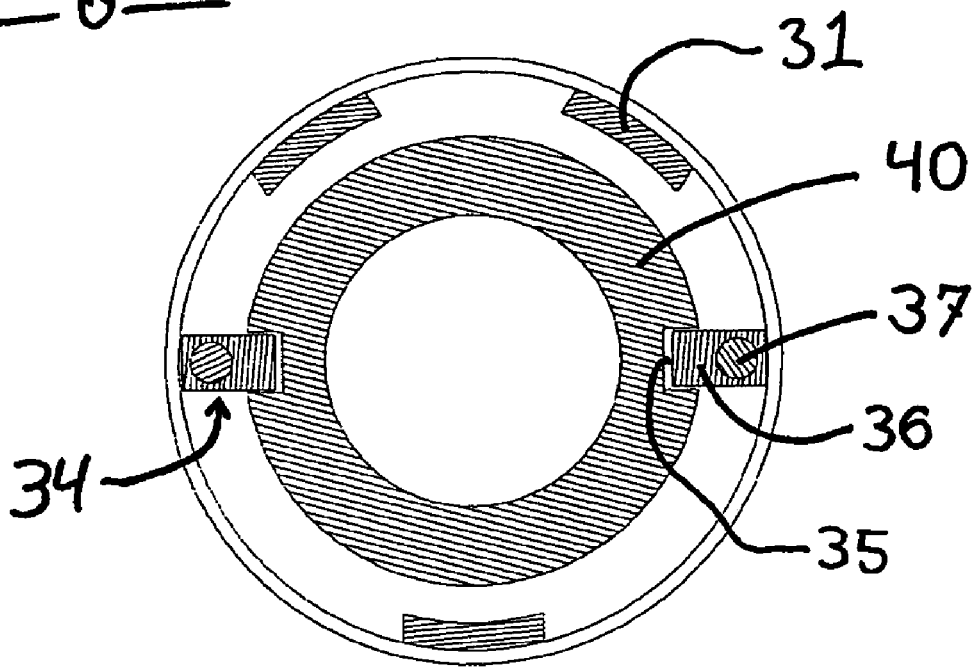
FIG. 9 is an axial cross section view taken along plane A from FIG. 11 showing a preferred embodiment of the rotational lock locking tabs engaged with the ground tube.

FIG. 9 is a cross section taken across the A plane of FIG. 11. FIG. 9 depicts a preferred embodiment of the rotational locking of the ground tube 40 showing the locking tabs 36 of the rotational lock 34 that fit into notches 35 in the ground tube 40. The axial guide rods 37 can be seen going through the cross section of the rotational lock 34. An embodiment of the axial connection elements 31 can be seen in cross section.

Figure 8:
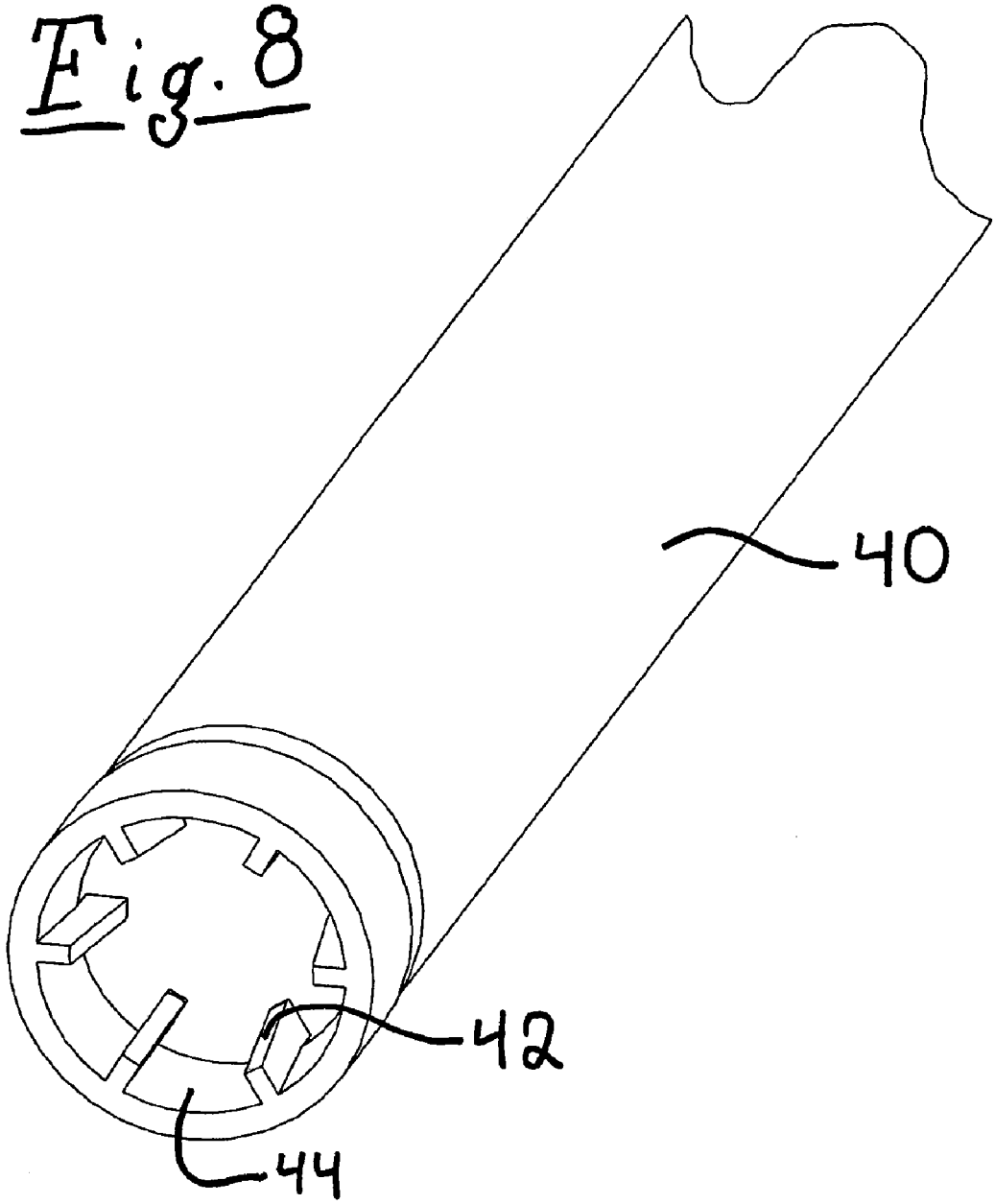
FIG. 8 is an isometric view of a preferred embodiment of the collecting end of the ground tube.

FIG. 8 depicts a preferred embodiment of the collecting end of the ground tube 40 showing one embodiment of the conical features 44 of the ground tube 40. The collecting end of the ground tube 40 is adapted to fit within the inner lip 43 of the drill bit 56 (as shown in FIG. 2). This embodiment also shows support fins 42 on the inner surface of the conical features 44 of the ground tube 40 which are adapted to fit between the constricting fingers 22 of the collet tube 20.

Referring to FIG. 10, the drill tube 50 is adapted to be rotated by an external drill driving means (not shown), such as an external motor. Additionally, the relative ground elements 33 are adapted to be raised and lowered by an external axial driving means, such as an external linear actuator. The collet nut 23 is geared on its outer wall so as to accept an external collet nut driving means (not shown). The ejection rod lead screw 38 is also shown as being capable of being driven by an external ejection rod lead screw driving means. The various driving means choices and setups are readily apparent to one skilled in the art. In a preferred embodiment, each driving means would be powered by a DC motor, either brushed or brushless.

A preferred embodiment of the rock core removal apparatus is conveniently employed by first drilling the drill tube 50, drill bit 56, ground tube 40, and collet tube 20 into a substrate 60 to a certain depth, thus allowing a core sample 66 to become located within the collet tube 20. At the desired depth, the collet nut 23 may be rotated to raise the collet tube 20 and cause the constricting fingers 22 to grip the core sample 66. After gripping, the ejection rod 39 may be commanded to be raised a small distance in order to lift the rotational lock 34 so it no longer engages the ground tube 40. The collet nut 23 may again be rotated to this time rotate the collet tube 20 and ground tube 40. Depending on the embodiment used, the core sample may be broken by torsion, tension, or a combination of torsion and tension. The drill tube 50, ground tube 40, and collet tube 20 may be removed from the substrate 60. At the same time, the drill bit 56 may either be removed from the substrate, or the ejection rod 39 can be commanded to be raised fully in order to raise the ground tube 40 to the drill bit quick-change position, thus releasing the drill bit 56 and leaving it in the substrate 60.

After breaking off the core sample 66 and before or after removing the collet tube 20 and ground tube 40 from the substrate 60, the ejection rod 39 can be commanded to be lowered while the collet nut 23 is rotated to allow the rotational lock 34 to again engage the ground tube 40. Then, the collet nut 23 can be rotated in an opposite direction that will cause the collet tube 20 to be lowered with respect to the ground tube 40, thus releasing the grip on the core sample 66. In a preferred embodiment of the invention, the core sample 66 is then pushed out of the collet tube 20 by commanding the ejection rod 39 to be lowered.

In one preferred embodiment, this invention is to be used for rock core removal in extraterrestrial environments. As such, an example of the general scale of the outer diameter of the drill bit is about 0.625 inches. It is readily apparent to one skilled in the art that different embodiments of this invention can be scaled up or down in order to accomplish different sized core removals. It is also readily apparent to one skilled in the art that the nature of this invention is not limited to use only in extraterrestrial environments.

The advantages of the above described embodiments and improvements are readily apparent to one skilled in the art as enabling the efficient and effective drilling and removal of a core sample. Additional design considerations may be incorporated without departing from the spirit and scope of the invention. Accordingly, it is not intended that the invention be limited by the particular embodiments or forms described above, but by the appended claims.

I claim:

1. A core removal apparatus for removing the core from a substrate, comprising:

a drill tube having a driving end and an attachment end, the driving end being adapted to accept an external driving means, a drill bit coaxially attached to the attachment end of the drill tube and being capable of drilling a core of the substrate and having an inner lip at a drilling end, a ground tube disposed coaxially within the drill tube and drill bit and having a driving end and a collecting end, the driving end of the ground tube having at least one notch, the collecting end of the ground tube being adapted to fit within the inner lip of the drill bit and having a conical feature, a collet tube disposed coaxially within and being rotationally coupled but not axially coupled to the ground tube and having a driving end and a collecting end, the driving end of the collet tube extending beyond the driving end of the ground tube and having an outwardly threaded region, the collecting end of the collet tube being adapted to fit within the inner lip of the drill bit and having a plurality of fingers capable of flexing radially inwards when an external force is applied thereon, the conical feature at the collecting end of the ground tube and the fingers being adapted to cause the fingers to flex radially inwards when the collet tube is displaced axially with respect to the ground tube, an ejection rod located coaxially within the collet tube adapted to move axially within the collet tube, and a driving system engaging the ground tube and collet tube, comprising:

an axial framework, the driving end of the ground tube being held axially fixed with respect to the axial framework, a collet nut threadedly disposed around the outwardly threaded region of the driving end of the collet tube and being held axially fixed and rotationally free with respect to the axial framework, and a rotational lock held rotationally fixed relative to the axial framework and containing at least one locking tab capable of engaging the notch on the driving end of the ground tube in order to rotationally couple the ground tube to the axial framework.

2. The core removal apparatus of claim 1, wherein:

the rotational lock is adapted to be moved axially with respect to the axial framework through at least two positions, wherein in a first position the locking tab of the rotational lock engages with the notch of the driving end of the ground tube to rotationally couple the ground tube and collet tube to the axial framework such that rotation of the collet nut will cause the collet tube to move axially with respect to the ground tube, and wherein in a second position the locking tab of the rotational lock disengages from the notch of the ground tube such that the ground tube and collet tube rotate together with respect to the axial framework.

3. The core removal apparatus of claim 2, wherein:

the ground tube is adapted with at least one cam follower, and the axial framework is adapted to accept the cam follower of the ground tube within a shaped recess, the shaped recess housing a core tensioning cam, the core tensioning cam being shaped such that rotation of the ground tube with respect to the axial framework will cause the ground tube to raise as the cam follower moves along the core tensioning cam.

4. The core removal apparatus of claim 2, wherein:

the drill bit is adapted with an internal grooved recess, the attachment end of the drill tube is adapted with at least one tabbed feature capable of deflecting inwards radially, the tabbed feature being adapted to axially lock the drill bit to the attachment end of the drill tube when not deflected inwards radially and unlock the dill bit from the drill tube when deflected inwards radially, the ground tube is adapted with a shaped recess and is adapted to move axially with respect to the drill tube through the at least two positions, wherein in said first position the ground tube provides bushing support to the tabbed features, and wherein in said second position, the ground tube provides the shaped recess into which the tabbed feature may deflect, and the rotational lock is further adapted to move to a third position, wherein in said third position the rotational lock engages the axial framework to move the ground tube axially in relation to the drill tube.

5. The core removal apparatus of claim 2, wherein:

the rotational lock is moved axially through its positions by axial movement of the ejection rod.

6. A core removal method comprising the steps of:

providing a collet tube adapted with at least two fingers capable of being flexed inwards radially and positioned at a collecting end of the collet tube, the collet tube being rotationally coupled to and coaxially disposed within a ground tube adapted with a conical feature capable of displacing the fingers of the collet tube inward radially when the collet tube is moved axially with respect to the ground tube, the ground tube being coaxially disposed within a drill tube and the drill tube being coaxially attached to a drill bit, drilling the collet tube, ground tube, and drill bit into a substrate so that a core of the substrate becomes located within the collet tube, gripping the core of the substrate by displacing the collet tube axially with respect to the ground tube such that the fingers of the collet tube deflect radially inwards and grab the core of the substrate, breaking the core of the substrate from the remaining substrate by applying at least one force, selected from the group consisting of torsion and tension, to the core of the substrate, releasing the core of the substrate by displacing the collet tube axially with respect to the ground tube in a direction opposite of the direction used when gripping the core, and ejecting the core of the substrate.

7. The core removal method of claim 6, wherein:

axial movement of the collet tube with respect to the ground tube is achieved through rotation of a collet nut with internal threads disposed around an externally threaded area on the collet tube, such that rotating the collet nut while keeping the collet tube rotationally fixed relative to the substrate will result in axial movement of the collet tube with respect to the ground tube.

8. The core removal method of claim 7, further comprising:

providing an axial framework, wherein during the step of drilling said axial framework is rotationally fixed relative to the substrate and wherein said collet tube is rotationally coupled to said ground tube and said ground tube is rotationally coupled to said axial framework.

9. The core removal method of claim 8, wherein:

the ground tube is removably rotationally coupled to the axial framework such that the torsional force applied to the core of the substrate during the breaking step is accomplished by rotating the collet nut while the ground tube is rotationally free from said axial framework and while sufficient gripping force is being applied by the fingers of the collet tube to the core of the substrate.

10. The core removal method of claim 8, wherein:

the ground tube is adapted with at least one cam follower capable of moving up a slope profile of at least one core tensioning cam, the core tensioning cam being integral to said axial framework, such that a tension force is applied to the core of the substrate during the breaking step by rotating the collet tube and ground tube wherein the cam follower of the ground tube rides up the slope profile of the core tensioning cam.

11. The core removal method of claim 6, further comprising the steps of:

providing the drill bit releasably engaged with said drill tube, and; releasing the drill bit from the drill tube.

12. The core removal method of claim 11, wherein the drill bit comprises at least one tab and wherein said tab deflects radially inward and wherein the ground tube comprises an outwardly facing shaped recess on said ground tube and wherein the step of releasing said drill bit is accomplished by moving the ground tube axially with respect to the drill bit to align said tab with said outwardly facing shaped recess.

13. A core removal method comprising the steps of:

providing a collet tube adapted with at least two fingers capable of being flexed inwards radially and positioned at a collecting end of the collet tube, the collet tube being rotationally coupled to and coaxially disposed within a ground tube adapted with a conical feature capable of displacing the fingers of the collet tube inward radially when the collet tube is moved axially with respect to the ground tube, the ground tube being coaxially disposed within a drill tube and the drill tube being coaxially and releasably attached to a drill bit, drilling the collet tube, ground tube, and drill bit into a substrate so that a core of the substrate becomes located within the collet tube, gripping the core of the substrate by displacing the collet tube axially with respect to the ground tube such that the fingers of the collet tube deflect radially inwards and grab the core of the substrate, breaking the core of the substrate from the remaining substrate by applying at least one force, selected from the group consisting of torsion and tension, to the core of the substrate, releasing the drill bit from the drill tube, removing the drill tube, ground tube and collet tube from the substrate, releasing the core of the substrate by displacing the collet tube axially with respect to the ground tube in a direction opposite of the direction used when gripping the core, and ejecting the core of the substrate.

* * * * *